US010344551B2

(12) United States Patent
Ellingsen

(10) Patent No.: US 10,344,551 B2
(45) Date of Patent: Jul. 9, 2019

(54) SUBSEA EQUIPMENT-PROTECTION APPARATUS

(71) Applicant: STATOIL PETROLEUM AS, Stavanger (NO)

(72) Inventor: Kjell Einar Ellingsen, Tananger (NO)

(73) Assignee: STATOIL PETROLEUM AS, Stavanger (NO)

( * ) Notice: Subject to any disclaimer, the term of this patent is extended or adjusted under 35 U.S.C. 154(b) by 0 days.

(21) Appl. No.: 15/531,220

(22) PCT Filed: Nov. 26, 2015

(86) PCT No.: PCT/NO2015/050228

§ 371 (c)(1),
(2) Date: May 26, 2017

(87) PCT Pub. No.: WO2016/085352

PCT Pub. Date: Jun. 2, 2016

(65) Prior Publication Data

US 2017/0328162 A1 Nov. 16, 2017

(30) Foreign Application Priority Data

Nov. 26, 2014 (GB) ..... 1421016.5

(51) Int. Cl.
*E21B 33/037* (2006.01)
*E21B 41/08* (2006.01)

(52) U.S. Cl.
CPC ..... *E21B 33/037* (2013.01); *E21B 41/08* (2013.01)

(58) Field of Classification Search
CPC ..... E21B 33/037; E21B 41/08; E21B 43/0122
See application file for complete search history.

(56) References Cited

U.S. PATENT DOCUMENTS 2,988,144 A 6/1961 Conrad
3,247,672 A * 4/1966 Johnson ..... B63C 11/44 166/351
3,353,364 A * 11/1967 Blanding ..... B63C 11/44 114/314
3,461,957 A * 8/1969 West ..... E21B 33/037 166/351

(Continued)

FOREIGN PATENT DOCUMENTS

GB 2015062 A * 9/1979 ..... E02B 1/00
GB 2234002 A * 1/1991 ..... E21B 33/037

(Continued)

OTHER PUBLICATIONS

International Search Report dated Feb. 5, 2016 in International Application No. PCT/NO2015/050228.

(Continued)

*Primary Examiner* — Matthew R Buck
(74) *Attorney, Agent, or Firm* — Wenderoth, Lind & Ponack, L.L.P.

(57) ABSTRACT

A subsea equipment-protection apparatus including: a cap (1) and a sleeve (2), wherein the cap and the sleeve are configured to be supportable by a foundation (6) of the subsea equipment (16). The cap and the sleeve are arranged such that at least a portion of the cap may enter an opening of the sleeve and be supported by the sleeve; and thereby the cap and sleeve cover and protect the subsea equipment.

21 Claims, 7 Drawing Sheets

(56) References Cited

U.S. PATENT DOCUMENTS 3,602,301 A * 8/1971 James ..... B63C 11/44 166/338
3,656,549 A 4/1972 Holbert, Jr. et al.
4,220,421 A * 9/1980 Thorne ..... E02B 3/127 166/368
4,273,472 A * 6/1981 Piazza ..... E21B 33/037 166/356
4,323,118 A * 4/1982 Bergmann ..... E21B 33/02 166/356
4,456,071 A * 6/1984 Milgram ..... E21B 43/0122 166/356
4,568,220 A * 2/1986 Hickey ..... E21B 43/0122 166/338
6,615,923 B1 9/2003 Lay, Jr. et al.
8,322,437 B2 * 12/2012 Brey ..... E21B 33/035 166/344
8,813,853 B1 8/2014 Peterson et al.
8,887,812 B2 * 11/2014 Caldwell ..... E21B 33/037 166/338
9,650,874 B2 * 5/2017 Caldwell ..... E21B 43/0122
2003/0010499 A1 1/2003 Qvam et al.
2004/0040702 A1 3/2004 Hergarden et al.
2011/0274493 A1 * 11/2011 Cutts ..... E21B 43/0122 405/60
2014/0262314 A1 * 9/2014 Ray ..... E21B 47/1025 166/364

FOREIGN PATENT DOCUMENTS

NO 20080901 8/2009
WO 96/06260 2/1996
WO WO-2012140076 A2 * 10/2012 ..... E21B 43/0122

OTHER PUBLICATIONS

Patents Act 1977: Search Report under Section 17 dated Apr. 1, 2015 in corresponding GB Application No. 1421016.5.
Search Report dated Apr. 17, 2019 in corresponding Russian Patent Application No. 2017122070 with English Translation.

* cited by examiner

SUBSEA EQUIPMENT-PROTECTION APPARATUS

BACKGROUND OF THE INVENTION

1. Technical Field

The invention relates to a subsea equipment-protection apparatus, for example an apparatus for protecting subsea-equipment such as a Christmas tree, a pump station, a chemical treatment station, a separation module, an umbilical termination head, a control system module, a power and hydraulic unit or a manifold from falling debris and/or trawling. The invention also relates to a method of lowering a subsea apparatus through water.

2. Description of the Related Art

Many types of subsea equipment are used, especially in the oil and gas industry. Often it is desired to locate the subsea equipment in areas of the ocean that are also used for other purposes, for example for shipping including for fishing. This gives rise to a risk for the subsea equipment from things such as falling debris and trawling. Hence there is a need to protect the subsea equipment.

In the prior art subsea equipment such as Christmas trees and manifolds are protected by a shielding structure that typically comprises a solid upper deck for protection from falling debris, and angled legs that support the upper deck and also provide protection from trawling. Such structures are large and cumbersome. They require foundations that can be costly and complicated to install. There must be moving parts to allow for access to the shielded equipment, such as a hatch or hatches in the upper deck. A typical prior art shielding structure is shown in FIG. 1.

Due to the complexity of these prior art shielding structures the oil and gas installation is often compromised by bringing multiple items of subsea equipment together under a single shield. Furthermore, the subsea equipment is often 'hung' from or otherwise mounted on the shielding structure. This is in order to take advantage of the existing foundation, but whilst this may appear to be an advantage it creates problems since it requires the subsea equipment to be designed in conjunction with the shielding structure, which hinders the design freedom for the subsea equipment and also the shielding structure, as well as preventing standardization of equipment made by different manufacturers and/or for different oil and gas producers.

Consequently the prior art shield designs result in constraints on the oil and gas installation, as well as being expensive and cumbersome.

SUMMARY OF THE INVENTION

Viewed from a first aspect, the present invention provides a subsea equipment-protection apparatus comprising: a cap and a sleeve. The cap and the sleeve are configured to be supportable by a foundation of the subsea equipment; and the cap and the sleeve are arranged such that at least a portion of the cap may enter an opening of the sleeve and be supported by the sleeve. The cap and the sleeve are thereby covering and protecting the subsea equipment.

A foundation of some sort for the subsea equipment must be present to support the subsea-equipment, regardless of whether or not it is desired to protect the subsea-equipment. Thus, the present invention advantageously utilizes the foundation of the subsea-equipment to support the protection apparatus. No additional foundations are required. In some exemplary embodiments, as discussed further below, the foundation may be coupled to the sleeve prior to installation of the foundation.

This is in contrast with the known art where, as is discussed above, when it is desired to protect the subsea-equipment, it is often the subsea-equipment that is supported by the foundations of the protection apparatus. In contrast to the prior art, the present protection apparatus may be sized to fit closely about the subsea equipment, making it significantly more lightweight than the known protection apparatus.

Since the present protection apparatus is supported by a foundation that would be present regardless of whether the protection apparatus is present, it is possible to use standard techniques to install the subsea installations on the sea bed. Further, it is possible to retro-fit existing subsea installations with the protection apparatus of the present invention. In addition, it is possible to easily adapt future subsea installations to include the protection apparatus of the present invention.

Further still, in contrast with the existing protection apparatus, due to the cooperation of the sleeve and the cap, the cap may be lifted off the subsea equipment. Thus, the subsea equipment can be easily exposed, e.g. for maintenance purposes.

The cap may have a hollow convex top portion. This shape reduces the possibility of trawler nets, etc. catching and snagging on the protection apparatus. Further, it allows for sufficient space to house the subsea equipment. It should be noted that as used herein the reference to the top/upper parts and bottom/lower parts are with reference to the orientation of the device when in use, where the base will be closer to the sea-bed (or other underwater surface) and the top will be further from the sea-bed. Similarly, references to a vertical direction or horizontal direction are used in a manner that is consistent with this, with the horizontal being generally parallel with the sea-bed and the vertical extending normal from the sea-bed.

The convex top portion may be continuously curved, or may be formed from a plurality of appropriately angled adjacent flat sections (e.g. to form a complex polyhedron), or may be formed from a mixture of curved and flat sections.

The hollow convex top portion may be generally dome-shaped. The dome-shape may be circular or non-circular in plan. The dome may be a spheroid-shaped dome (e.g. either a spherical dome, or an oblate spheroid-shaped dome, or a prolate spheroid-shaped dome, etc.) or a non-spherical dome (e.g. an ovoid-shaped dome or a capsule-shaped dome, etc.). Thus, when in use, the horizontal cross-section (i.e. the plan view) of the convex top portion may be a circle, an ellipse, an oval or a stadium, etc.

Further, the cap may comprise a top portion having a plurality of hollow convex shapes adjacent one another.

The exact shape and form of the cap should be decided based upon the shape of the subsea equipment it is designed to protect. For example, for a Christmas tree, a circular cross-section (in plan view) may be used, and for a manifold, an oval or stadium cross-section (in plan view) may be used The cap may comprise a lower portion. The lower portion may be configured to enter the sleeve. The lower portion may be the base of the convex top portion. The lower portion may comprise a wall extending from the base of the convex top portion. The wall may extend from the entire perimeter of the convex top portion. Opposing portions of the wall may be parallel with one another (i.e. the wall may form a tube-like portion). The lower portion may be received fully within the sleeve when the cap is in use, or alternatively a part of the lower portion may remain outside of the vertical extent of the sleeve during use.

The cap and the sleeve may have a corresponding shape. When in use, the cross-sections (taken in a horizontal plane) may have corresponding shapes.

The inner dimension of the cross-section of the sleeve may be approximately equal to, or greater than, the outer dimension of the cross-section of the cap. Alternatively, the inner dimension of the cross-section of the cap may be approximately equal to, or greater than, the outer dimension of the cross-section of the sleeve. By "approximately equal to" it is meant that the relevant dimensions are set such that there is close fit between the cap and the sleeve, such that relative movement is reduced. There will, of course, always be a certain degree of tolerance present, such as between 50 to 250 mm.

Thus, the cap may be prevented from rotating/pivoting inside the sleeve by the required tolerance. Hence, the only way of removing the cap from its geometrical lock may be by lifting it vertically.

However, it is not essential to have the dimensions of the cap match those of the sleeve. Indeed, one advantage of the invention is that an exact size match of the sleeve and the cap is not necessary, and hence the need for custom-built caps/sleeves is greatly reduced.

For example, the sleeve may be approximately 6 m to 20 m across. If circular in cross-section, the diameter of the sleeve may be approximately 6 m to 20 m. If rectangular in cross-section, the sleeve may have dimensions of approximately 6 m to 20 m by 6 m to 20 m. The dimensions of the cap may be substantially similar to those of the sleeve, but may have a small reduction for clearance, for example of around 50 to 250 mm.

The subsea equipment-protection apparatus may be configured such that the cap is held in position by the sleeve and the weight of the cap. Thus, the cap may not be fixed to the foundation/sleeve/sea bed. This eases its installation and removal. The cap may be removed when access to the subsea equipment is desired.

The cap may be a molded cap. This greatly eases manufacture of the cap. Since the cap can have a convex hollow shape, molding can be especially advantageous to easily manufacture such complex shapes. In contrast, the known protection apparatus requires fabrication such as cutting, fitting, welding, etc. The cap may be molded from composites, such as FRP, GRP and the like.

The cap may include a sandwich construction. Such a construction may provide reinforcement of the cap, and may provide the cap with thermal insulation properties.

The cap may provide thermal insulation so as to prevent heat loss from the subsea equipment. The cap may be constructed of a thermally insulating material.

The cap may consist of one component. This may ease manufacture, installation and removal of the cap.

Alternatively, the cap may comprise a plurality of sections. This may ease access to the subsea equipment. For example, the cap may comprise a hatch. The hatch may be positioned at the top of the cap when in use. The hatch may be removable.

The cap may be formed of two-sections. Each segment may be approximately half of the cap. The respective sections may be symmetrical with one another. The sections may touch when installed. There may be a gap between the sections when installed.

The cap may have an unbroken surface. By "unbroken surface" it is meant that the surface of the cup is substantially free of holes. This provides good protection over the entirety of the subsea equipment.

The convex top portion of the cap may have an unbroken surface. An upper part of the convex top portion may have an unbroken surface. The unbroken surface may extend from the top of the cap far enough down the cap such that installation of the protection apparatus is eased (for example, far enough that when the cap is inverted, the cap or protection apparatus as a whole can float). As is described in more detail below, the cap may be inverted during transport, such that it effectively forms a hull-shape. The cap thus can float and can be towed out to sea to the desired location.

The cap may comprise holes. This reduces the weight of the cap, the amount of material used and the hydrodynamic forces associated with moving the cap, e.g. during installation. In addition, it can allow for easy inspection of the subsea equipment located within the cap. The holes may be formed in the lower portion. The holes may be formed in the convex top portion. The holes may be formed in a lower part of the convex top portion. The cap may comprise a cage.

The cap may have a stackable shape, for example with angled walls slightly off vertical similar to stackable cups, thereby enabling multiple similar caps to be transported in a stack.

The sleeve may be configured to be fixed to the foundation. This allows the sleeve to held in position relative to the foundation, sea bed and subsea equipment, and hence act as a support to other components (e.g. the cap). As noted above, the foundation may advantageously be coupled to the sleeve prior to installation of the foundation. The sleeve may be joined to the foundation during fabrication by any suitable means.

This feature is particularly beneficial when the foundation is a cylindrical foundation such as, for example, a suction anchor. Thus, in one preferred embodiment, the subsea equipment-protection apparatus includes a foundation coupled to the sleeve, preferably joined to the sleeve before the foundation is installed, and optionally a suction anchor foundation. When installing the apparatus, the suction anchor (with sleeve attached) may first be secured to the sea bed, and then optionally a conductor/pipe for the subsea equipment may be installed through the suction anchor.

The sleeve may comprise generally vertically extending walls about the opening for the cap.

The sleeve may comprise holes, for example holes through the vertical walls. These holes reduce the weight of the sleeve, and allow inspection of the subsea equipment. The holes in the sleeve may be placed to align with holes in the lower portion of the cap.

The sleeve may be configured to support the weight of the cap, and to support the cap in a lateral direction. The sleeve may contact the lower portion of the cap. The sleeve may contact the base of the cap. The sleeve may comprise one or more component(s) extending inward, or outward, from the walls of the sleeve. The cap may rest on the component(s). The component may comprise a shelf. The components may comprise a plurality of bars. The component(s) may be positioned at a height (such as around 2 m) above the sea bed. This allows the cap to rest at this height above the seabed. This means the cap need not extend to the sea bed, and hence can be reduced in size. Further, it allows for inspection of the subsea equipment through only the sleeve below the horizontal components. Alternatively, the weight of the cap may be supported directly by the foundation.

The horizontal cross-section of the sleeve may be a circle, an ellipse, an oval or a stadium, or any shape complementing the shape of the cap. This shape may be of the inner dimension of the sleeve, or of the inner and outer dimension of the sleeve.

The subsea equipment-protection apparatus may comprise an angled trawl deflector between the seabed and the sleeve and/or cap. The trawl deflector further prevents trawler nets, etc. catching and snagging on the protection apparatus. The trawl deflector may be configured to circumferentially surround the cap.

The trawl deflector may be angled at between 45° and 60° relative to the seabed. The trawl deflector may extend from the seabed. The trawl deflector may extend to the top of the sleeve.

The trawl deflector may comprise a plurality of struts arranged to extend at an angle between the sleeve/cap and the seabed/foundation. The struts may be substantially equally spaced around the perimeter of the sleeve.

In some exemplary embodiments the trawl deflector includes a frustoconical surface arranged to extend between the sleeve/cap and the seabed/foundation.

The trawl deflector may be configured to be supported in a lateral direction by the sleeve. The trawl deflector may have a horizontal cross-section (i.e. in plan view) that is complementary in shape to that of the sleeve. The trawl deflector may have an inner dimension that is approximately equal to (but marginally larger than) the outer dimension of the sleeve. This allows the trawl deflector to fit over the sleeve, and be supported by the sleeve. The inner dimension of the trawl deflector may be greater than the outer dimension of the sleeve.

The trawl deflector may generally be hollow. The trawl deflector may comprise holes through its outer surface. This helps to reduce the weight of the protection apparatus and to reduce the hydrodynamic forces associated with moving the apparatus, e.g. during installation. Further, the holes may be used to inspect the subsea equipment without removing the trawl deflector.

The trawl deflector may be configured to be held in position by the weight of the trawl deflector. Thus, the trawl deflector may not be fixed to the foundation/sleeve/sea bed. This eases its installation and removal. The trawl deflector may be removed when access to the subsea equipment is desired.

The trawl deflector may be fixed to the sleeve and optionally both the sleeve and trawl deflector may be coupled to the foundation before installation of the foundation.

The protection apparatus may comprise a flexible flow line, wherein the trawl deflector supports the flexible flow line. The flexible flow line may be present to connect the subsea equipment to nearby subsea equipment, or to equipment on the surface.

The flexible flow line may be coiled around the outer circumference of the trawl deflector, preferably the frustoconical trawl deflector, as this shape allows for easy coiling/uncoiling. Retainer straps may hold the flow line in place when desired (e.g. during installation of the trawl deflector).

The protection apparatus may comprise a leak-monitoring device such as, for example, a pressure sensor or a gas sensor. This may be provided on the interior surface of the cap. The device may be located above the subsea equipment. The device may be located in an upper region of the cap. The device may be located at the uppermost point of the interior surface of the cap.

The leak-monitoring device may be fixed to the subsea equipment. Optionally the leak-monitoring device is not fixed to the cap. The leak-monitoring device may be suspended above the subsea equipment in an upper region of the cap. This is advantageous since the cap can be removed from the subsea equipment without removal of the leak-monitoring device. This allows the cap to be removed without having to disconnect the leak-monitoring device from, for example, a surface-based monitoring system to which the device may be connected. This eases removal of the cap.

Leak-monitoring of subsea equipment is an important consideration. In known protection systems, no such leak-monitoring is provided. Instead, the leak-monitoring may be provided integrally as part of the subsea-equipment. Due to the presence of the cap and the location of the leak-monitoring device, leaking hydrocarbons may gather in an upper region of the cap. These leaking hydrocarbons, which are typically less dense than water, displace water from the upper region of the cap and may be held in the upper region of the cap by the cap. In this regard the dome-shaped cap is particularly advantageous.

The cap may comprise a hole in an upper portion of the cap, for example a circular hole. The hole may be provided at the upper most position of the cap. The hole may be provided at a center of symmetry of the cap. Such a hole may be used during the installation of the cap, as explained further below. The hole may be configured (e.g. shaped/sized) such that a lifting device and/or lifting wire may be inserted through the hole.

The cap may comprise a tubular portion extending from the hole (i.e. from the edge of the cap forming the hole) and into the upper portion of the cap. Thus, a cavity may be formed between the tubular portion and the cap. The leak-monitoring device may be positioned in this cavity. This cavity may allow leaking hydrocarbons to be gathered even when the hole is present. The tubular portion may also strengthen the hole, which may be advantageous when the cap is lifted/moved by a lifting device and/or lifting wire inserted through the hole.

The hole may also provide access through the cap to the subsea-equipment, e.g. for a conveyance/pipeline, even when the cap is in position.

In another aspect, the invention provides a subsea installation comprising a piece of subsea equipment mounted to a foundation and the subsea-equipment-protection apparatus as described above. The sleeve is mounted to the foundation and surrounds the subsea equipment, and the cap covers the subsea equipment.

As discussed above, the foundation may be provided by a suction anchor. A suction anchor is advantageous since it is lightweight and easy to install.

The piece of subsea equipment may be equipment for oil and gas production, for example it may be a Christmas tree or a manifold. The piece of subsea equipment may be a pump station, a chemical treatment station, a separation module, an umbilical termination head, a control system module or a power and hydraulic unit.

In order to install the Christmas tree on the suction anchor, the suction anchor may first be secured to the sea bed, and then a conductor/pipe may be installed through the suction anchor. Examples of such methods can be seen in US Publication No. 2012/0003048.

In a further aspect, the invention also provides a subsea system comprising a plurality of the subsea installations described above, wherein the subsea installations are connected in a satellite arrangement. The system may include, for example, a manifold connected to multiple Christmas trees, with each of the manifold and the Christmas trees being protected by means of a sub-sea protection apparatus as described above.

In known subsea systems where the pieces of subsea equipment are protected, all of the subsea equipment is located under a single, large protective cover. In contrast, the present invention allows different pieces of subsea equipment to be protected by different protection equipment. This allows the different pieces of subsea equipment to be distributed as desired (which can be over a considerable area, for example spread about an area of up to 200 m radius), rather than being forced to house all the equipment at the same location.

The separation of the pieces of subsea equipment can be further advantageous since other pieces of subsea equipment (e.g. a booster pump) can be added to the subsea system between the existing pieces of subsea equipment without having to move/disturb/rearrange the existing subsea pieces of equipment.

The pieces of subsea equipment may be connected to one another via one or more pipeline(s) on the sea bed. The pipeline(s) may be protected by one or more concrete mattresses.

Viewed from a further aspect, the invention provides a method of installation of the subsea equipment-protection apparatus described above, the method comprising: mounting the sleeve to the foundation of the subsea equipment; locating the cap at the opening of the sleeve, and inserting the at least a portion of the cap into the opening of the sleeve so that the cap is retained within the sleeve. The method may include providing the subsea equipment-protection apparatus or parts thereof with features as discussed above.

The method may include transporting the cap and/or sleeve to the installation site, for example via a barge or by floating it and towing it. Advantageously, the cap may be floated to the installation site. This means that the cap may be installed without the need for a large vessel or a vessel with lifting capacity. In embodiments where the cap has an unbroken surface (e.g. for the top/upper portion) then the cap may be inverted and may float without the need for additional buoyancy. Alternatively, or additionally, the cap may have a stackable shape, thereby enabling multiple similar caps to be transported in a stack.

The cap may be located at the opening by sinking the cap, for example by capsizing an inverted cap to flood it, or by releasing air from a non-inverted cap so that it floods with water from beneath as it is submerged. Once submerged the cap may be hung from a line, or multiple lines, and directed to be above the opening in the sleeve. Again, this procedure can conveniently be carried out by a small vessel with no need for a large lifting capacity.

The cap may be held within the sleeve simply by its weight. This means that there is no need for any kind of complex subsea operation when installing the cap.

The sleeve may be mounted to the foundation by any suitable means. In some advantageous example embodiments the sleeve is coupled to the foundation before installation of the foundation. This means that the sleeve and foundation can be transported and installed together, which minimizes the sub-sea work that is required.

The foundation may be installed using known techniques. A preferred foundation type for some embodiments is a suction anchor. This can easily be installed with the sleeve already coupled to the suction anchor as discussed above, since the method of installation of a suction anchor is not hindered by a sleeve being present atop the anchor. In some exemplary embodiments the sleeve together with the suction anchor is installed and then a conductor or pipe is installed through the anchor to the sea bed for the subsea equipment.

The subsea-equipment may be installed after the sleeve is installed (which may be with the foundation or subsequently), and the cap is fitted once the sub-sea equipment is in place.

When the foundation is a suction anchor and this is joined to the sleeve before installation then the sleeve and anchor assembly may advantageously be transported by floating, for example with the assembly inverted. As with floating of the cap this means that no special vessel is required. A small vessel with a modest lifting capability can be used. The sleeve and anchor may be submerged using known techniques for suction anchors and then steered to the required location on the sea-bed, again using known techniques. With this approach the equipment and training required to install the sleeve is very similar to that required to install the suction anchor and consequently the cost of introducing the sleeve and cap system is minimized.

Viewed from another aspect, which is not presently being claimed, the invention provides a method of lowering an apparatus through a body of water comprising lowering a guiding element and a weight through the body of water. The lower end of the guiding element is attached to the weight such that the guiding element is under tension and is maintained in a generally vertical orientation when in its lowered position. The apparatus is lowered through the body of water whilst it is being guided by the guiding element.

The apparatus of this aspect may be the cap and/or sleeve and/or trawl deflector and/or foundation and/or subsea equipment described above in connection with the previous aspects and optional features thereof. This aspect may be combined with any of the features of the previous aspects.

This method allows an apparatus to be lowered through a body of water in a controlled manner. The position of the apparatus is more precisely maintained and controlled due to the presence of the guiding element and its interaction with the apparatus.

The guiding element and weight may be lowered through the water freely, i.e. they may free fall through the water. Optionally, no external forces are applied to the guiding element and/or weight during lowering (other than hydrodynamic forces from the water, of course). This is advantageous as the guiding element and weight may sink faster than the apparatus.

The apparatus may be lowered through the water freely, i.e. it may free fall through the water guided by the guiding element. Optionally no external vertical forces are applied to the apparatus during lowering (other than hydrodynamic forces from the water). The guiding element may provide a horizontal restraining force to the apparatus during lowering.

Thus, there is no need to have any connection between the apparatus and a surface vessel during lowering of the apparatus. The lowered apparatus may simply be in cooperation with the guiding element and may be allowed to sink freely. This is particularly advantageous. In conventional methods of lowering an apparatus, the apparatus is directly connected to a surface vessel via a crane and cable or the like. Due to sea swells and currents, and because the apparatus may be shaped such that it may be subject to large hydrodynamic forces, large stresses can occur on the surface vessel, the connection and the apparatus. In the present aspect, since the apparatus need not be directly connected to a surface vessel, no such stresses may occur.

It should be noted that whilst the guiding element and weight are in a generally vertical orientation when suspended and the guiding element is under tension due to the weight being suspended from it, the guiding element may curve and drift, and the weight may drift slightly due to differing currents/swells.

The lowered apparatus may be light weight. The apparatus may be configured (e.g. sized/shaped) such that it is subject to greater hydrodynamic forces, e.g. hydrodynamic drag, than the guiding element and weight. The guiding element and the weight may therefore sink faster than the lowered apparatus, and may be less affected by sea swells and currents. The apparatus may have a larger surface area-to-weight ratio than the guiding element and the weight.

The weight may have a mass of 30,000-70,000 tonnes (metric tons), for example a mass of about 50,000 tonnes (metric tons). The weight may be formed of any suitable material, preferably a metal and ideally a metal that is relatively dense, such as carbon steel, stainless steel, lead or a combination thereof. The weight may have a volume of 2-6 $m^3$, for example it may be a sphere or a cylinder. A typical example weight is a cylinder of 1 m diameter and 5 m length. The weight may be denser than the apparatus, and is denser than water.

The apparatus may have a mass of 15,000-35,000 tonnes (metric tons), for example a mass of about 25,000 tonnes (metric tons). The apparatus may be formed of materials typical for the particular apparatus concerned. Where the apparatus is a protection apparatus as discussed above then the apparatus may be formed of GRP, FRP or steel. The apparatus may have a volume larger than the volume of the weight. An exemplary apparatus has a dome shape with a radius of 2-10 m and height 2-10 m. The apparatus is denser than water.

The weight and the guiding element may be connected to a surface vessel/platform. Whilst the weight and the guiding element are connected to a surface vessel/platform, since they may be configured such that they are subject to lesser hydrodynamic forces than the apparatus to be lowered, the stresses on the surface vessel/platform, the guiding element and the weight may be substantially lower than the stresses on the conventional surface vessel, connection and apparatus mentioned above.

The weight and the apparatus may be configured such that the weight supports the apparatus when they are in contact. The weight may act to stop the sinking/lowering of the apparatus. The apparatus may have a hole through which the guiding element may be passable, but through which the weight may not be passable. The hole may interact with the guiding element to allow the apparatus to be guided as it is lowered. Thus, the guiding element and weight may take the form of a mass at the end of a line, with the line being able to be suspended from a surface vessel and the line passing through a hole in the apparatus that is to be lowered.

The hole may be located at a point of symmetry of the apparatus. Thus, when the weight stops the apparatus and/or the apparatus is suspended, the apparatus is maintained in a stable position.

The hole may be the hole as described above in relation the previous aspects.

The weight may be configured such that it may not pass through the hole. The weight may be configured such that it may optionally pass through the hole. The weight may be generally cylindrical.

The weight may comprise protruding portions. The horizontal protrusions may protrude in a generally horizontal direction, when the weight and guiding member are deployed. The protrusions may be configured such that they cooperate with the apparatus to stop the apparatus sinking or to lift the apparatus. The protrusions may increase the horizontal dimensions of the weight such that the weight cannot pass through the hole. The cross-section of the remainder of the weight (i.e. where the protrusions are not located) may be sized and shaped such that it may pass freely through the hole.

The protrusions may be located at a lower portion of the weight. The protrusions may be located at an upper portion of the weight. The protrusions may be located at an intermediate portion of the weight.

The protrusions may be retractable. The protrusions may be releasable. This may allow the weight to optionally pass through the hole. The protrusions may be controllable from the surface, e.g. from the crane from which the guiding element and the weight are suspended. The protrusions may be locking latches.

The protrusions may be retracted during lowering of the weight. The protrusions may be deployed when the weight is lowered, and before the apparatus sinks to the depth of the lowered weight.

The weight may stop the apparatus from descending further. The weight may allow the apparatus to be lifted and/or moved laterally.

The guiding element may be a wire or cable, for example a steel wire of 50-100 mm diameter. The guiding element may be formed of metal. The guiding element may be spooled/unspooled as it is raised/lowered, for example from a winch or similar on a surface vessel.

The guiding element may be attached to a crane or winch. The crane or winch may act to lower, preferably by fast pay out, the guiding element and weight. The crane or winch may be suspended over the surface of the water.

The method may further comprise, prior to the lowering of the guiding element and weight, suspending the apparatus using the weight, preferably over the side of a surface vessel/platform, preferably at a height above the water surface, e.g. 1 to 2 m. As lowering commences, the weight, the guiding element and the apparatus may effectively drop to the water surface.

However, the suspension may occur at the water surface, or at a depth beneath the water surface.

The method may further comprise stopping the lowering of the guiding element and the weight, preferably such that the weight is at a depth close to the bed of the body of water, e.g. 1 or 2 m above the bed. The bed may be a sea bed.

The method may further comprise, once the apparatus has reached the weight, moving the apparatus to its desired position by moving the guiding element and weight vertically and/or laterally. This may occur by using a crane/winch, or by moving the surface vessel/platform.

The method may further comprise, once the apparatus is over its desired position on the bed, e.g. when the cap of the previous aspects is located above the sleeve/subsea equipment, lowering the apparatus into position, e.g. on the bed/sleeve/foundation.

The method may further comprise, retracting the weight and guiding element.

In a further aspect, which is not presently being claimed, the invention provides a system for lowering an apparatus through a body of water. The system includes an apparatus to be lowered, a guiding element for guiding the apparatus as it is lowered and a weight, the lower end of the guiding element being attached to the weight such that the guiding element is under tension and is maintained in a generally vertical orientation when in its lowered position, and the apparatus being arranged to be coupled to the guiding element so that it can be lowered through the body of water whilst being guided by the guiding element.

As discussed above, the apparatus may be arranged to drop freely through the water whilst being guided, and hence the apparatus may be arranged to be coupled to the guiding element so that it can move freely in a vertical direction under the influence of gravity. The system of this aspect may include any or all preferred features of the apparatus, guiding element and weight as discussed above in relation to the method of the preceding aspect. As noted above, the apparatus may be the cap and/or sleeve and/or trawl deflector and/or foundation and/or subsea equipment described above in connection with the previous aspects and optional features thereof. This aspect may be combined with any of the features of the previous aspects.

In a preferred implementation, the system further includes a surface vessel or platform that holds the guiding element as discussed above.

BRIEF DESCRIPTION OF THE DRAWINGS

Certain preferred embodiments of the invention will now be described by way of example only and with reference to the accompanying drawings in which:

FIG. 5 is a side cross-section of a subsea equipment-protection apparatus for a manifold or the like;

DETAILED DESCRIPTION OF THE INVENTION

Figure 1:
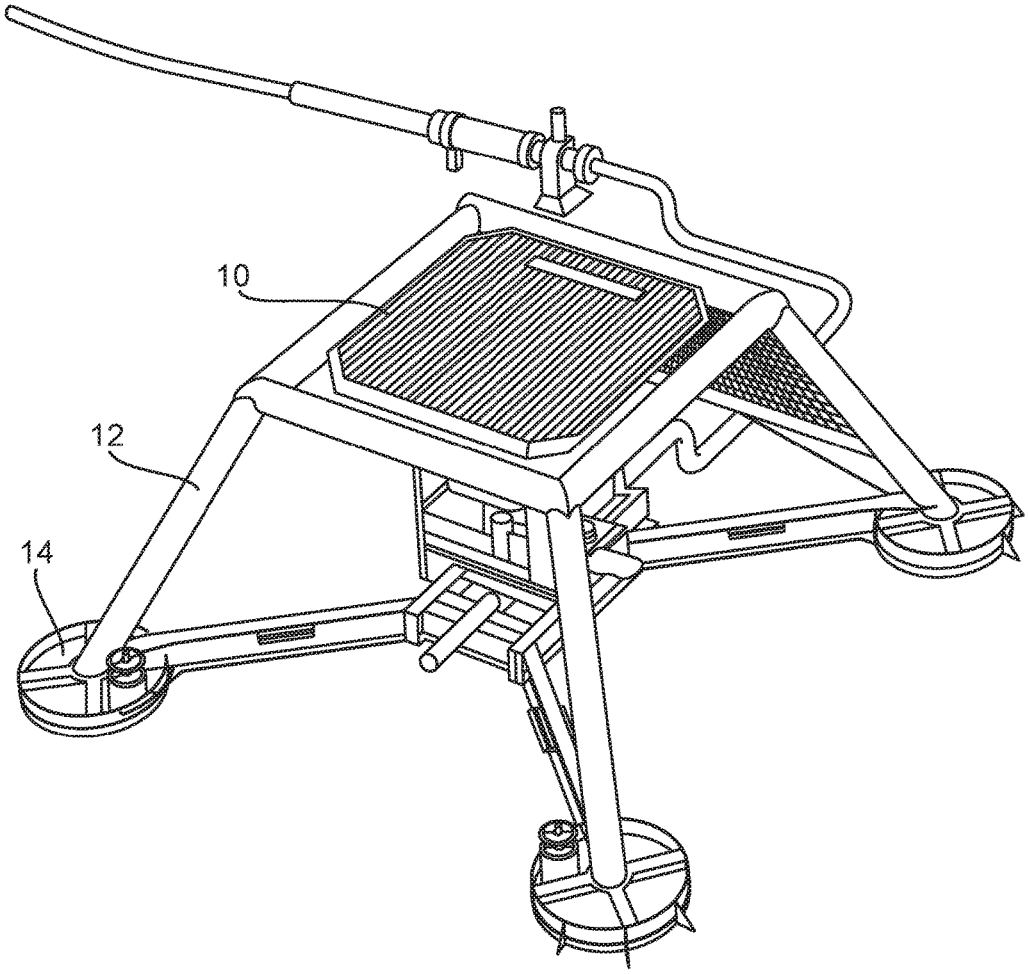
Fig. 1 (PRIOR ART)
FIG. 1 shows a prior art shielding structure.

The prior art shielding structures are typically as shown in FIG. 1. A deck structure 10 is supported on legs 12 that are placed on foundations 14. The deck structure 10 shields subsea equipment 16 from falling debris and the legs 12 act as trawl deflectors. It will be appreciated that the prior art structure is large and cumbersome, requires complicated foundations, and also puts constraints on the subsea equipment 16 since it must be supported by the shielding structure in some way.

Figure 2:
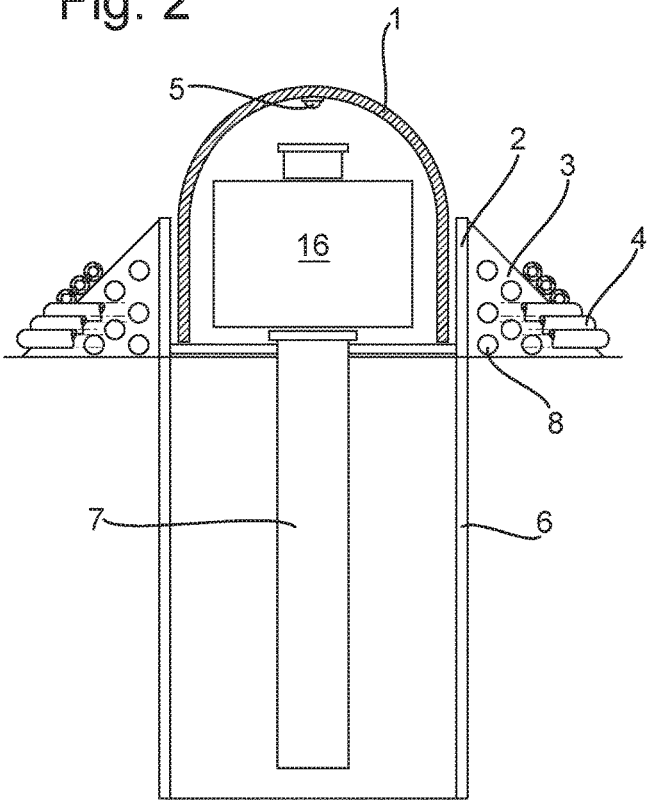
FIG. 2 is a side cross-section of a subsea equipment-protection apparatus with a cap and sleeve arrangement.

FIG. 2 shows a subsea equipment-protection apparatus with a cap and sleeve arrangement. It is shown in side cross-section. The concept is based on a pipe in pipe philosophy where a "dome/cup" protection cap 1 fits within a circumferential sleeve 2. In plan view, the cap 1 and sleeve 2 are circular in this example. The cap 1 is restrained from movement in a horizontal direction, and is prevented from rotating/pivoting, by the sleeve 2. The cap 1 is secured in place by its weight and by the corresponding shape of the cap and sleeve. This means that no locking device is required to protect the subsea equipment 16 from lateral trawloads and downward vertical impact loads.

Figure 4:
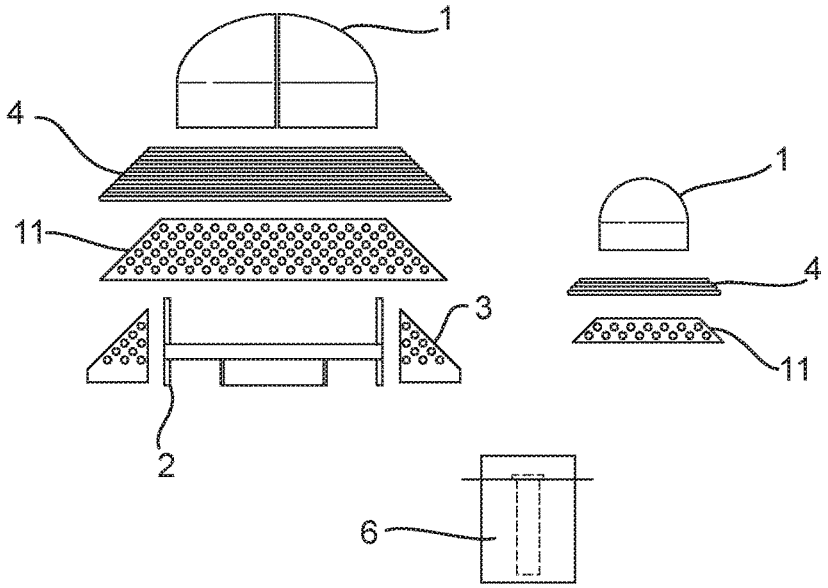
FIG. 4 is an exploded view of a subsea equipment-protection apparatus with a cap and a sleeve.
Figure 5:
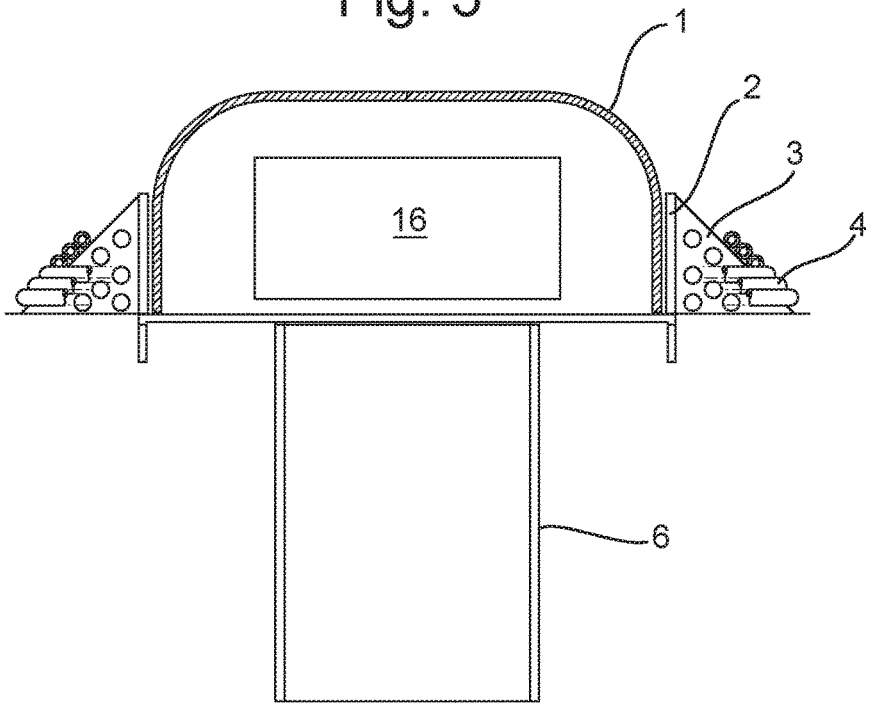
Figure 6:
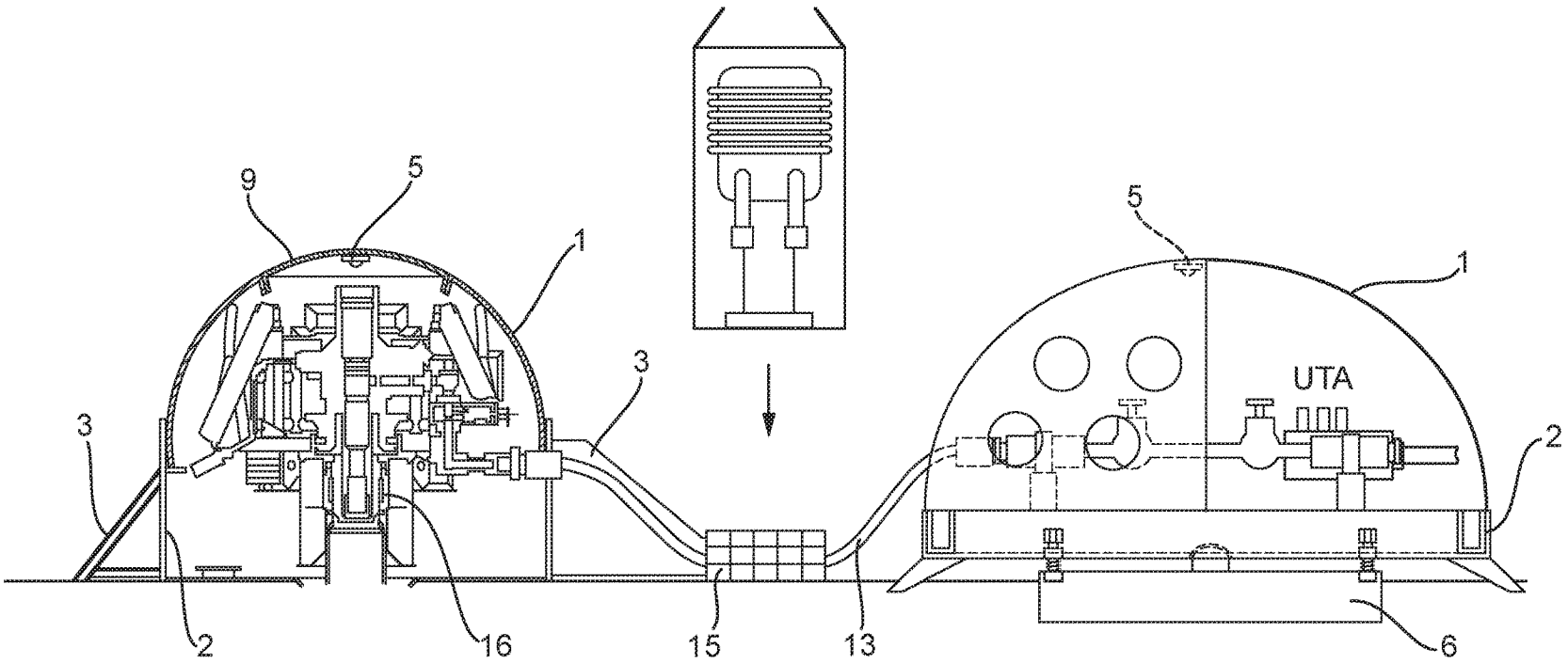
FIG. 6 shows a subsea equipment-protection apparatus for a Christmas tree together with a subsea equipment-protection apparatus for a manifold.

The concept can be used on a single suction anchor 6 for protection of a Christmas tree (XT), as shown, or for protecting other structures (manifold, UTA, pumps etc.) where a sleeve ring can be integrated to the foundation support. FIGS. 4 to 6 show other subsea equipment as well as XT. The protection cap 1 can be in one unit or several segments locked in place when fitted inside the sleeve ring 2. The sleeve ring 2 accommodates trawl deflectors 3. In the example of FIG. 1, the trawl deflectors 3 take the form of triangular panels fitted to the side walls of the sleeve 2, these may be mounted about the circumference of the sleeve 2, for example at 90 degree intervals. The trawl deflectors 3 can have holes 8 for reducing their weight and minimizing the forces generated by ocean currents. The trawl deflectors may support a flexible flowline 4 during installation. This provides a convenient way to hold the flow line 4 and to transport it to the sea-bed.

FIG. 2 also shows the use of a sensor 5 for detecting build-up of gas or pressure leakage from the subsea equipment 16 or from any other source. The figure further illustrates the way that a pipeline 7 can be drilled through the suction anchor foundation 6.

Figure 3:
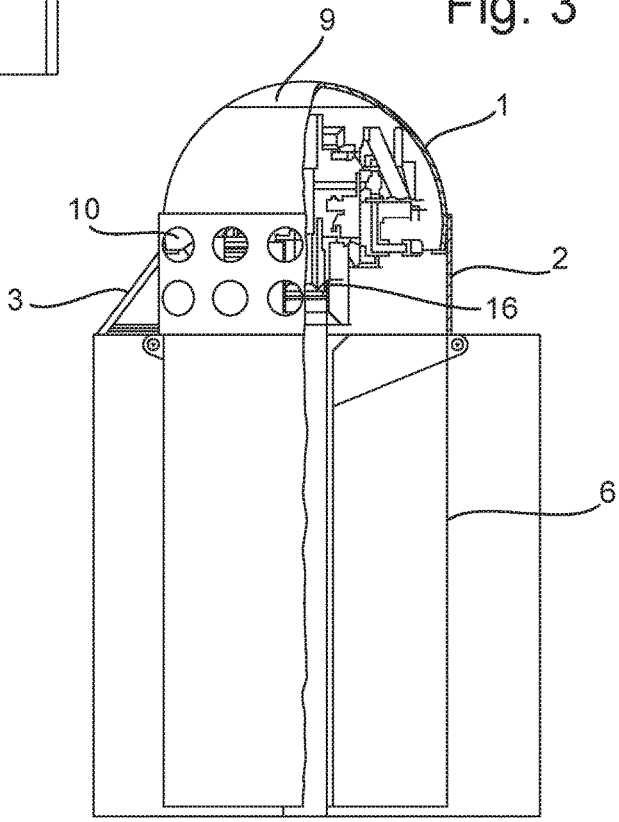
FIG. 3 shows a similar subsea equipment-protection apparatus to that of FIG. 2 in partial section view.

Another example is shown in FIG. 3. This has the same basic features as the example of FIG. 2, with a cap 1, sleeve 2, trawl deflector 3 and foundation 6. In this example the trawl deflector 3 uses an angled beam rather than a triangular plate. This figure also illustrates additional optional features, including an access hatch 9 in the upper part of the cap 1 and holes 10 in the sleeve 2. The holes 10 in the sleeve can be used to allow access to the subsea equipment 16. The hatch 9 has a similar purpose. FIG. 3, as compared with FIG. 2, also shows how the cap 1 can be supported by an upper part of the sleeve ring (in FIG. 3) or by sitting at the base of the sleeve ring 2 (in FIG. 2).

The basic main elements are shown in two further examples in FIG. 4, in exploded view. On the left of the figure, a protection apparatus for a manifold or similar structure is shown. The cap 1 is non-circular in plan view in order to accommodate the rectangular shape of a manifold. The sleeve 2 has a similar shape to the cap 1. The cap 1 fits into the sleeve 2 and the sleeve 2 has trawl protectors 3. On the right of FIG. 4, an XT protection apparatus for XT is shown. In both cases, a flexible flow line 4 can be wrapped around the sleeve 2 as discussed above. A further feature shown in FIG. 4 is a frustoconical element 11 for trawl deflection. Thus, with these examples the trawl deflector can be made up of the angle plate 3 and the frustoconical element 11. Of course, with the manifold protection apparatus, the frustoconical element 11 is not a true cone since it must also follow the non-circular shape of the cap 1.

FIG. 5 shows another example of a protection apparatus, similar to that on the left of FIG. 4. The subsea equipment 16 may be a manifold. The apparatus of FIG. 5 is similar in form to that of FIG. 2 aside from that the shape in plan view would be non-circular, for example a stadium shape or an oval, so that it fits closely around generally rectangular subsea equipment 16.

Figure 7:
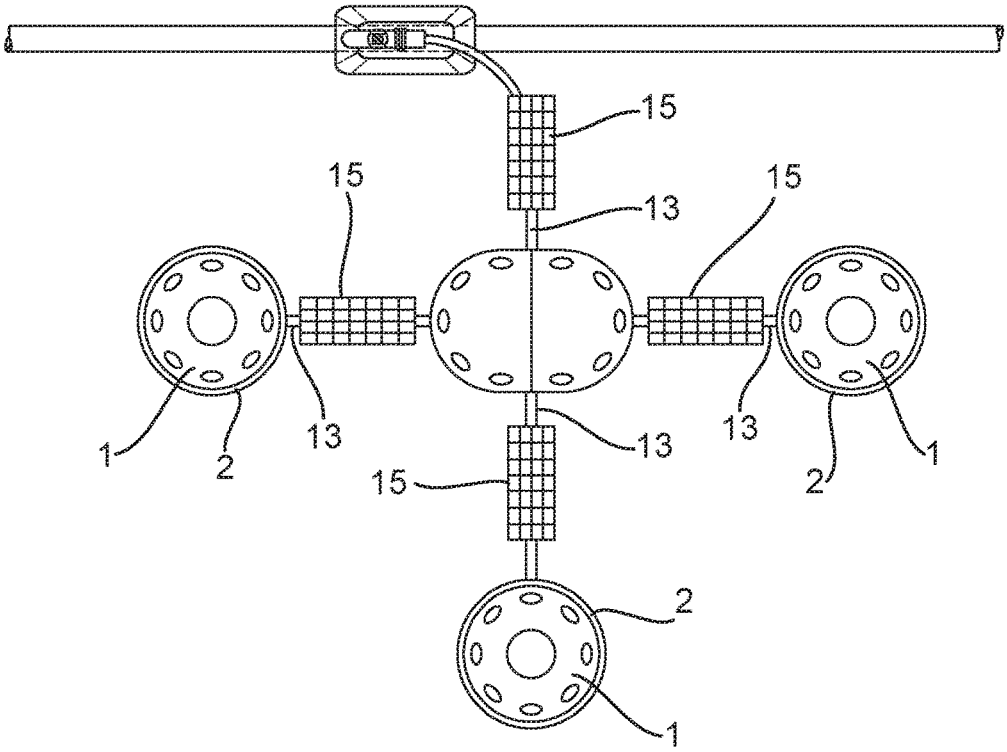
FIG. 7 is a plan view of a layout of a subsea installation.

The cap and sleeve protection apparatus can be used in a subsea installation to protect various different parts of subsea equipment, as shown in FIG. 6 and FIG. 7.

In FIG. 6 a CAN and XT on the left are protected by a first cap 1 and sleeve 2 arrangement, which would be generally circular in plan view, and a manifold on the right is protected by a second cap 1 and sleeve 2 arrangement, which would be non-circular in plan view. The XT protection apparatus is shown in side cross-section. The manifold protection apparatus is shown in partial side cross-section. In FIG. 7 a subsea installation is shown in plan view. Three Christmas trees with circular caps 1 are connected to a manifold with a stadium shaped cap 1.

The subsea equipment is connected together by line 13, which can be protected by a concrete mattress 15. Since the various elements of subsea equipment 16 are separated apart and have separate protection then they can be placed freely wherever is most convenient, and also it is possible to easily remove and add elements in a modular fashion. Intervening elements could also be easily added later on, for example a booster pump 17 as shown in FIG. 6. This type of flexible approach is not possible with prior art shielding structures where multiple pieces of equipment are combined together under one shield.

Figure 8:
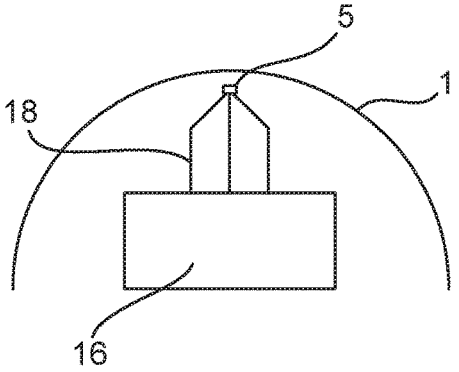
FIG. 8 shows a cross section of another embodiment of the protection apparatus.

With reference to FIG. 8, in contrast to FIGS. 2 and 6, the sensor 5 is fixed to the subsea equipment 16 via support 18, such that the sensor is suspended above the subsea equipment 16 in an upper region of the cap 1. Thus, the sensor 5 is not fixed to the cap 1.

Figure 9:
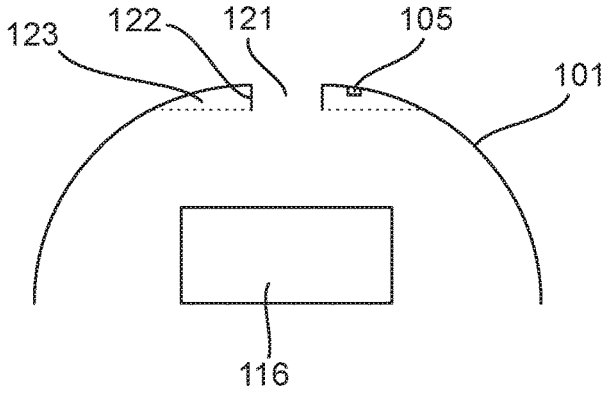
FIG. 9 shows a cross section of another embodiment of the protection apparatus.

With reference to FIG. 9, in contrast to the previously described embodiments, the cap 101 comprises a hole 121 in an upper portion of the cap 101. The hole 121 is provided at a center of symmetry of the cap 101. A tubular portion 122 extends from the hole 121 and into the upper portion of the cap 101. Thus, a cavity 123 is formed between the tubular portion 122 and the cap 101. The leak-monitoring device 5 is positioned in this cavity 123 and is attached to the cap 101.

Figure 10:
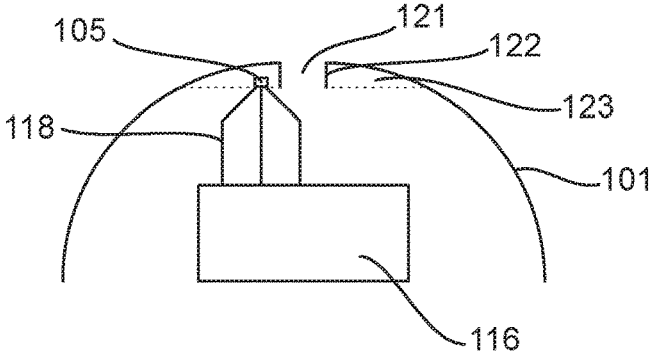
FIG. 10 shows a cross section of another embodiment of the protection apparatus.

FIG. 10 shows is a similar embodiment to FIG. 9, except that the sensor 105 is fixed to subsea equipment 116 via support 118, similarly as shown in FIG. 8.

Figure 11A:
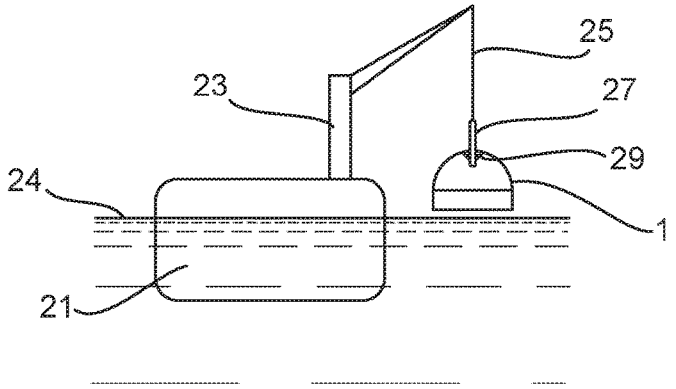
FIGS. 11*a*, 11*b* and 11*c* show an embodiment of one aspect of the invention of a method of lowering an apparatus through a body of water.
Figure 11B:
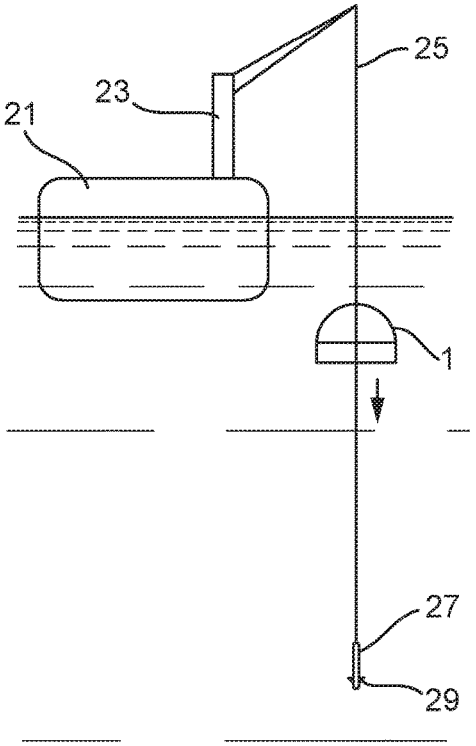

FIGS. 11*a* and 11*b* illustrate an embodiment of a method of lowering an apparatus through a body of water. As shown in FIG. 11*a*, the method comprises suspending the cap 1 above a sea surface 24. The cap 1 is supported by retractable protrusions 29 of a weight 27 which is connected to a lower end of a cable 25. The cable 25 is connected to a crane 23 located on a vessel 21.

The method further comprises releasing the cable 25 by fast pay out. Thus, the cap 1 and the weight 27 begin to free fall. Due to their respective shapes, the weight 27 is subject to smaller hydrodynamic forces than the cap 1. Thus, the weight 27 sinks faster than the cap 1.

As shown in FIG. 11*b*, once the weight 27 has reached its desired depth, the fast pay-out is ceased and the weight 27 is suspended by the cable 25. The weight 27 causes the cable 25 to be under tension, and hence held in a generally vertical direction.

Figure 11C:
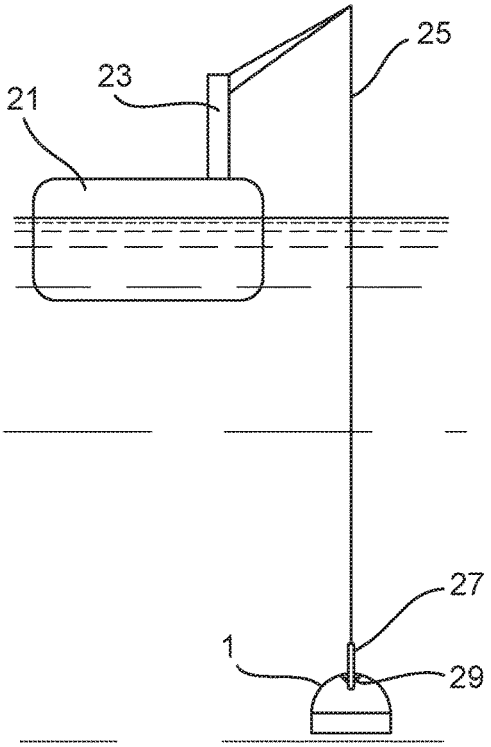

Due to interaction between the cap 1 and the cable 25 (e.g. via hole 121 discussed above), the cap 1 may descend whilst being guided by the cable 25. As shown in FIG. 11*c*, once the cap 1 reaches the weight 27, the protrusions 29 again support the cap 1 and prevent the cap 1 from descending further.

The invention claimed is:

1. A subsea equipment-protection apparatus comprising: a cap and a sleeve, wherein the cap and the sleeve are configured to be supportable by a foundation of the subsea equipment on a seabed; and the cap and the sleeve are arranged such that at least a portion of the cap is configured to enter an opening of the sleeve and be supported by the sleeve; the cap and the sleeve thereby covering and protecting the subsea equipment, wherein the cap has a hollow convex top portion to reduce the possibility of trawler nets catching and snagging the protection apparatus, and wherein the cap is held in position only by the weight of the cap and a complementary shape of the cap and the sleeve, and wherein the cap is prevented from pivoting relative to the sleeve by a close fit between the cap and the sleeve to create a geometrical lock from which the cap can be removed only by vertically lifting the cap.

2. A subsea equipment-protection apparatus as claimed in claim 1, wherein the hollow convex top portion is generally dome-shaped.

3. A subsea equipment-protection apparatus as claimed in claim 1, wherein the cap is a molded cap, wherein the cap has an unbroken surface.

4. A subsea equipment-protection apparatus as claimed in claim 1, wherein the cap consists of one component.

5. A subsea equipment-protection apparatus as claimed in claim 1, wherein the cap comprises a plurality of sections.

6. A subsea equipment-protection apparatus as claimed in claim 1, wherein the cap comprises holes, and the sleeve comprises holes.

7. A subsea equipment-protection apparatus as claimed in claim 1, wherein the sleeve is configured to be fixed to the foundation.

8. A subsea equipment-protection apparatus as claimed in claim 1, comprising an angled trawl deflector between the seabed and the sleeve and/or the cap, wherein the trawl deflector comprises a plurality of struts or plates arranged to extend at an angle between the sleeve and/or cap and the seabed and/or the foundation.

9. A subsea equipment-protection apparatus as claimed in claim 1, further comprising an angled trawl deflector between the seabed and the sleeve and/or the cap, wherein the trawl deflector includes a frustoconical surface arranged to extend between the sleeve and/or the cap and the seabed and/or the foundation.

10. A subsea equipment-protection apparatus as claimed in claim 8, wherein the trawl deflector is configured to be held in position by the weight of the trawl deflector.

11. A subsea equipment-protection apparatus as claimed in claim 1, further comprising a flexible flow line, wherein a trawl deflector supports the flexible flow line.

12. A subsea equipment-protection apparatus as claimed in claim 1, further comprising a leak-monitoring device on an interior surface of the cap.

13. A subsea equipment-protection apparatus as claimed in claim 1, wherein the cap is configured to provide thermal insulation to the subsea-equipment.

14. A subsea equipment-protection apparatus as claimed in claim 1, wherein the cap comprises a hole in an upper portion of the cap, and the cap comprises a tubular portion extending from the hole and into the upper portion of the cap.

15. A method of installation of the subsea equipment-protection apparatus as claimed in claim 1, the method comprising: mounting the sleeve to the foundation of the subsea equipment; locating the cap at the opening of the sleeve, and inserting at least a portion of the cap into the opening of the sleeve so that the cap is retained within the sleeve.

16. A method as claimed in claim 15, further comprising transporting the cap and the sleeve to the installation site by floating the cap and the sleeve to the installation site, wherein, during transportation, the cap is inverted, and the cap is located at the opening by sinking the cap.

17. A method as claimed in claim 15, wherein, prior to the mounting, the cap is hung from one or more lines and directed to be above the opening in the sleeve.

18. A method as claimed in claim 15, wherein the sleeve is mounted to the foundation before installation of the foundation, and the subsea-equipment is installed after the sleeve is installed, and the cap is fitted once the sub-sea equipment is in place.

19. A subsea installation comprising a piece of subsea equipment mounted to a foundation and a subsea-equipment-protection apparatus comprising:

a cap and a sleeve, wherein the cap and the sleeve are supported by the foundation of the subsea equipment on a seabed; and the cap and the sleeve are arranged such that at least a portion of the cap is configured to enter an opening of the sleeve and be supported by the sleeve; the cap and the sleeve thereby covering and protecting the subsea equipment, wherein the sleeve is mounted to the foundation and surrounds the subsea equipment, wherein the cap covers the subsea equipment, and the cap has a hollow convex top portion to reduce the possibility of trawler nets catching and snagging the protection apparatus, and wherein the subsea equipment-protection apparatus is configured such that the cap is held in position only by the weight of the cap and a complementary shape of the cap and the sleeve, and wherein the cap is configured such that the cap is prevented from pivoting relative to the sleeve by a close fit between the cap and the sleeve to create a geometrical lock from which the cap can be removed only by vertically lifting the cap.

20. A subsea installation as claimed in claim 19, wherein the foundation is provided by a suction anchor, and the piece of subsea equipment is a X-mas tree or a manifold.

21. A subsea system comprising a plurality of the subsea installations as claimed in claim 19, wherein the subsea installations are connected in a satellite arrangement, and the pieces of subsea equipment are connected to one another via one or more pipelines on the sea bed.

* * * * *